United States Patent [19]

Op de Beeck

[11] 4,052,637

[45] Oct. 4, 1977

[54] HALOGEN INCANDESCENT LAMP

[75] Inventor: Herbert Kamiel Maria Op de Beeck, Eindhoven, Netherlands

[73] Assignee: U.S. Philips Corporation, New York, N.Y.

[21] Appl. No.: 745,489

[22] Filed: Nov. 26, 1976

[30] Foreign Application Priority Data

Dec. 8, 1975 Netherlands ..... 7514249

[51] Int. Cl.[2] ..... H01K 1/18

[52] U.S. Cl. ..... 313/222; 313/273; 313/274; 313/279

[58] Field of Search ..... 313/222, 273, 274, 279

[56] References Cited

U.S. PATENT DOCUMENTS 3,416,024 12/1968 Young ..... 313/273

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

The invention relates to halogen incandescent lamps for use in photoreproduction processes and with a simple and cheaper filament construction. In this construction the filament sections emitting light during operation form one assembly with the connection conductors interconnecting them and connection conductors of a large length have in one or more places helically wound turns which are shortcircuited by a support connected thereto.

6 Claims, 1 Drawing Figure

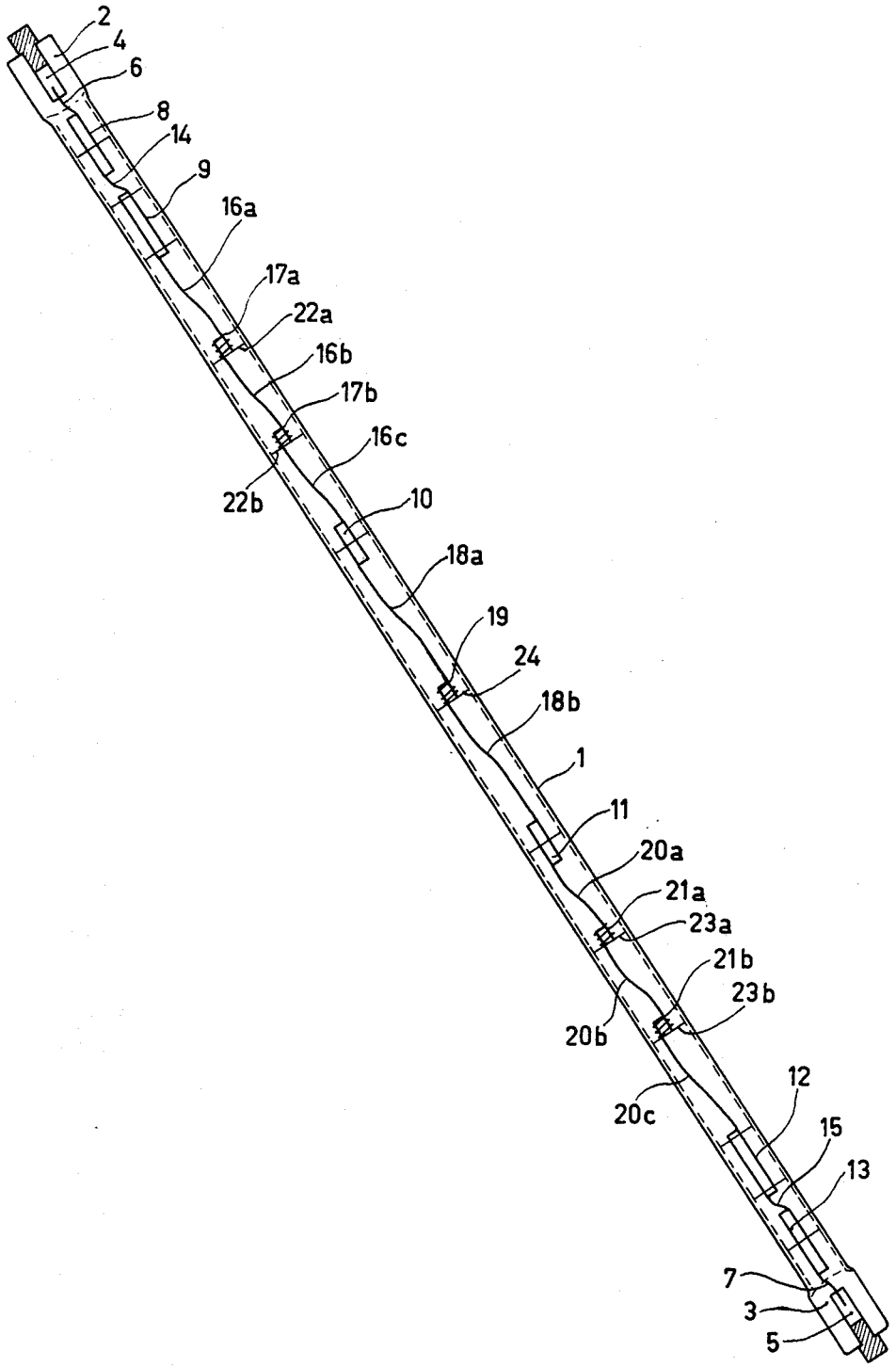
2
4
6
8
14
9
16a
17a
22a
16b
17b
16c
22b
10
18a
19
24
18b
1
11
20a
21a
23a
21b
23b
20b
12
20c
15
13
7
3
5

HALOGEN INCANDESCENT LAMP

The invention relates to a halogen incandescent lamp comprising (a) a tubular light-pervious lamp vessel provided at its ends with vacuum-tight seals in which current leadthrough conductors are incorporated, (b) a filament which extends longitudinally in the lamp vessel and is connected to the current lead through conductors and has several helically wound filament sections separated spatially by connection conductors and (c) supports in contact with the filament and with the wall of the lamp vessel which fix the filament in the transverse direction.

Such lamps are known inter alia from the U.S. Pat. No. 3,416,024 and are used in photo-reproduction processes. In order to achieve that an object is uniformly exposed by such a lamp throughout its width, the filament has a number of helically wound filament sections which during operation radiate light and which near the ends of the lamps are usually longer or are arranged closer together than more towards the centre. These sections are separated spatially by connection conductors which during operation do not emit light or emit substantially no light. This is caused by the fact that the connection conductors have a smaller resistance.

In other types of lamps, for example those described in German Offenlegungsschrift No. 2,141,791, in which the connection conductors consist of the same wire material as the filament sections, the connection conductors do not emit light or emit substantially no light because as compared with the turns of the filament sections, they lose much more thermal energy and are not maintained at higher temperature by live conductors which are situated in the immediate proximity.

In the lamps according to said German Offenlegungsschrift, the connection conductors between the filament sections are comparatively short. It has been found that, when in said filament construction longer connection conductors are used, deformations in the filament occur during operation. Pitch variations in the filament sections occur, as a result of which places of higher temperature arise in the filament sections. It is also possible for turns of the filament sections to touch each other and hence become short-circuited.

These phenomena result in a non-uniform exposure of the object: in the former case an exposure which is locally too strong, in the latter case an exposure which is locally too weak.

These phenomena do not occur in the lamps as disclosed in U.S. Pat. No. 3,416,024. The long connection wires of said lamps consist of rods on which screwthread is cut or on which wire is wound helically. The filament sections have a deformed turn at either end to which a helically wound wire end adjoins. The connection conductors are screwed in at that area. The heavy connection conductors of said lamp are kept centered in the lamp vessel by supports.

However, the construction of the said United States Patent Specification is very expensive. Not only is the material consumption of said lamps high, the construction also requires a large number of components to be assembled.

It is an object of the invention to provide a simpler and cheaper construction.

In agreement herewith, the invention relates to a halogen lamp of the kind mentioned in the preamble which is characterized in that filament sections and connection conductors constitute one structural unit and that at least connection conductors between filament sections which have a mutual distance of at least 40 mm locally have helical turns which are short-circuited by a support connected thereto.

The helically wound part is preferably localised in said connection conductors in such manner that the distance to each of the adjacent filament sections is not more than 40 mm. In a preferred embodiment, very long connection conductors have several of such helically wound parts, so that the distance between said parts and between a filament section and one of the wound parts is not more than 40 mm.

In general the filaments of the lamp will consist of wire having a diameter between 100 and 500 μm. According as the wire thickness of a filament is larger, preferably shorter connection conductors too are locally provided with helically wound turns short-circuited by supports.

Therefore, in a more preferred embodiment connection conductors between filament sections having a mutual distance of at least 30 mm are locally provided with helical turns short-circuited by a support connected thereto. In a more preferred embodiment the helically wound part of the connection conductor is localised so that the distance to each of the adjacent filament sections is not more than 30 mm or the connection conductor has several of such helically wound parts so that the distance between said parts and between a filament section and one of the wound parts is not more than 30 mm.

As a rule, the number of turns of a wound part of a connection conductor will be 3 to 4, although larger numbers may also be used. As supports with which the turns can be short-circuited are to be considered inter alia the usual supports.

A support is to be preferred of a helically wound wire which surrounds the turns in the connection conductor or is enclosed in said turns, which wire is coiled towards the wall of the lamp vessel. Such supports are known inter alia from the said United States Patent Specification.

The lamps according to the invention have been found to have a filament which is stable also after a long time in operation.

The invention will be described in greater detail with reference to FIG. 1.

FIG. 1 shows diagrammatically a lamp according to the invention.

The lamp vessel 1 is closed at each end by pinch seals 2 and 3, respectively, in which current leadthrough conductors 4 and 5, respectively are incorporated. The limbs 6 and 7 of the filament extending longitudinally in the lamp vessel are connected to the current leadthrough conductors. The filament (**6–21*b*) consists of the filament sections 8, 9, 10, 11, 12, 13 which are separated by connection conductors. The connection conductors 14 and 15 connect the filament sections 8 and 9 and 12 and 13, respectively, which are at a mutual distance of 4 mm. The connection conductor 16*a* – 16*c* connects the filament sections 9 and 10, connection conductors 20*a* – 20*c* connect the filament sections 11 and 12. The distance between the filament sections 9 and 10 and between 11 and 12** is 58 mm.

Incorporated in both connection conductors are two helically wound parts **17*a* and 17*b*, and 21*a* and 21*b*, respectively, which are short-circuited by the supports 22*a* and 22*b* and 23*a* and 23*b*, respectively, and are fixed in a transverse direction. The distance between 17***a* and 17*b* and that between 21*a* and 21*b* is 16 mm. The distance from each of the helically wound parts 17*a* and 17*b*, 21*a* and 21*b* to the nearest filament section is 17 mm.

A helically wound part 19 which is short-circuited by the support 24 is wound between the filament sections 10 and 11, which are at a mutual distance of 56 mm, in the connection conductor 18*a* – 18*b*. The distance from part 19 to the filament sections 10 and 11 is 26 mm.

The lamp vessel is filled with argon and 0.3% by volume of $CH_2Br_2$ to an overall pressure of 2.5 atmosphere at room temperature. During operation the lamp consumes a power of 1000 Watts at 115 V and has a filament having a wire diameter of 258 $\mu$m.

What is claimed is:

1. A halogen incandescent lamp having (a) a tubular light-pervious lamp vessel provided at its ends with vacuum-tight seals in which current leadthrough conductors are incorporated, (b) a filament which extends longitudinally in the lamp vessel and is connected to current leadthrough conductors and has several helically wound filament sections separated spatially by connection conductors, and (c) supports in contact with the filament and with the wall of the lamp vessel which fix the filament in the transverse direction, characterized in that filament sections and connection conductors constitute one structural unit and that at least connection conductors between filament sections which have a mutual distance of at least 40 mm locally have helical turns short-circuited by a support connected thereto.

2. A halogen lamp as claimed in claim 1, characterized in that the distance between filament sections and a helically wound part of a connection conductor is not more than 40 mm.

3. A halogen lamp as claimed in claim 2, characterized in that the distance between two helically wound parts of a connection conductor is not more than 40 mm.

4. A halogen lamp as claimed in claim 1, characterized in that connection conductors between filament sections having a mutual distance of at least 30 mm locally have helically wound turns short-circuited by a support connected thereto.

5. A halogen lamp as claimed in claim 4, characterized in that the distance between filament sections and a helically wound part of a connection conductor is not more than 30 mm.

6. A halogen lamp as claimed in claim 5, characterized in that the distance between two helically wound parts of a connection conductor is not more than 30 mm.

* * * * *